US006386216B1

(12) United States Patent
Cubelli

(10) Patent No.: US 6,386,216 B1
(45) Date of Patent: May 14, 2002

(54) CANE AND GRASPING DEVICE

(76) Inventor: Kenneth Cubelli, 9 Drake Ct., Boonton, NJ (US) 07005

( * ) Notice: Subject to any disclaimer, the term of this patent is extended or adjusted under 35 U.S.C. 154(b) by 0 days.

(21) Appl. No.: 09/597,220

(22) Filed: Jun. 20, 2000

(51) Int. Cl.[7] ..... A45B 3/00
(52) U.S. Cl. ..... 135/66; 135/70; 135/77
(58) Field of Search ..... 135/66, 70, 75, 135/77

(56) References Cited

U.S. PATENT DOCUMENTS 3,093,402 A * 6/1963 Sisson
3,467,116 A * 9/1969 Ringewaldt
3,763,872 A * 10/1973 Gooley
4,811,750 A * 3/1989 McAllister ..... 135/66
5,176,160 A * 1/1993 Osborn ..... 135/66
5,433,234 A * 7/1995 Lapere ..... 135/66
5,535,833 A * 7/1996 Mathews
5,636,650 A * 6/1997 Kroeze ..... 135/66
5,640,985 A * 6/1997 Snyder et al. ..... 135/66 X
5,724,765 A * 3/1998 Wegner
6,058,953 A * 5/2000 Stefanelli ..... 135/66

* cited by examiner

*Primary Examiner*—Robert W. Gibson, Jr.
(74) *Attorney, Agent, or Firm*—Thomas L. Adams

(57) ABSTRACT

An upper tubular member is telescoped within a lower sleeve or sheath having a cane foot at its lowermost end. The sleeve is adjustably set along the member to set the length of the cane by a detent assembly employing a pawl and aperture arrangement. An article grasping mechanism is located at the lower end of the upper tubular member and includes a pair of toothed jaws with meshing teeth. The jaws extend from the tubular member at one end, opposite a handle attached to the tubular member at the other end. A lever is attached at the handle end and is coupled to the jaws via cables and pulleys. The jaws are biased open and are closed by the cables as the handle is squeezed closed. The sleeve encloses the jaws in the closed state when not in use. When the sleeve is removed from juxtaposition over the jaws, the jaws are biased open by torsion springs. The handle and lever are then used to close the open jaws over an article to be grasped.

24 Claims, 7 Drawing Sheets

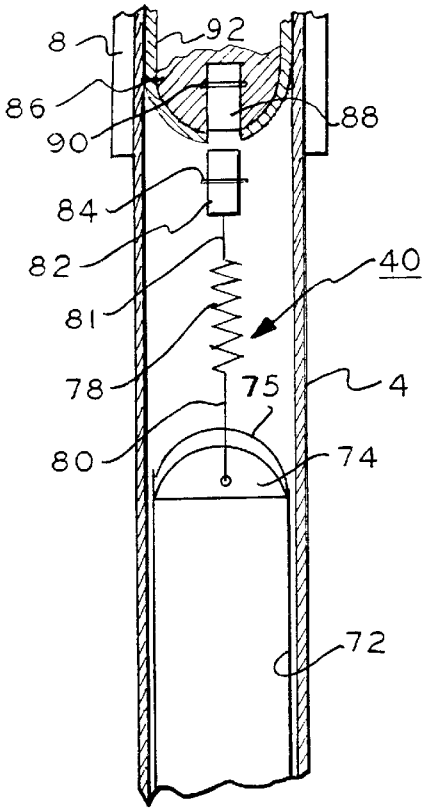
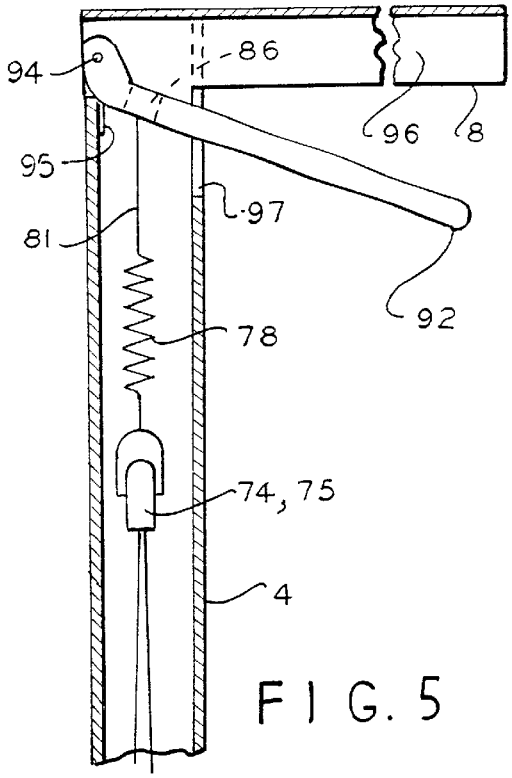
FIG. 5
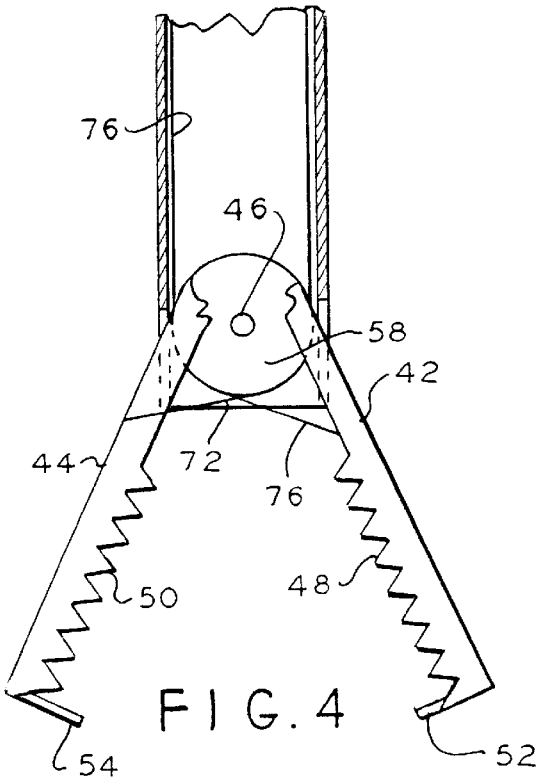
FIG. 4
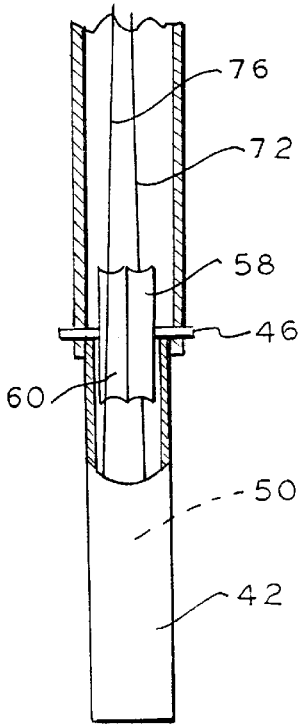

12
8
92
4
22
20
14
32
34
36
6
16
40
44
42

FIG.15
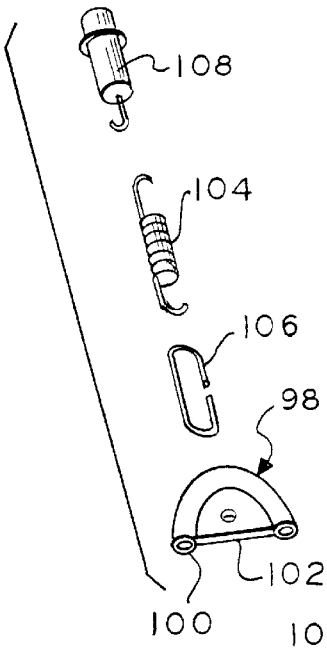
FIG.12
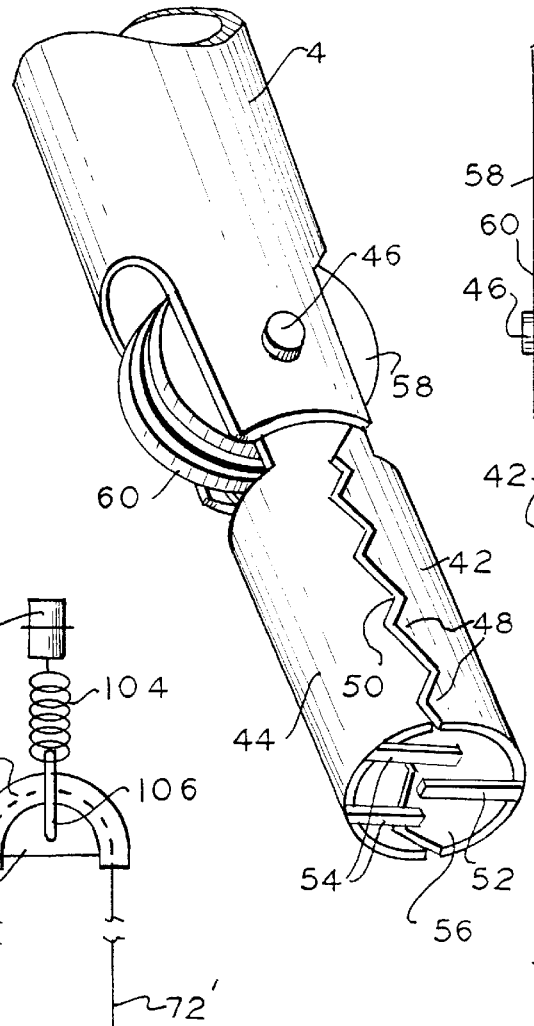
FIG.13
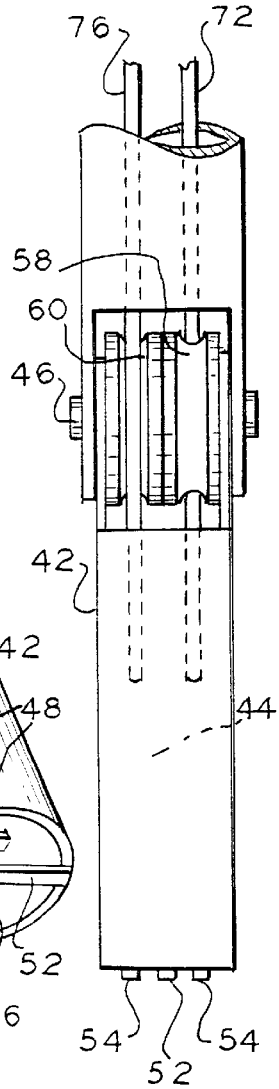
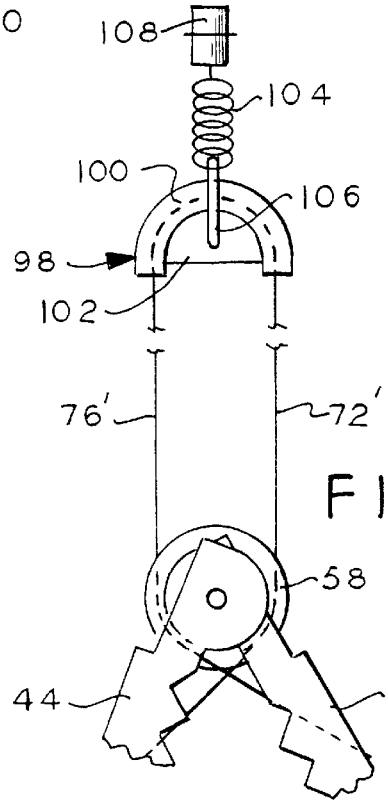
FIG.14

FIG. 18
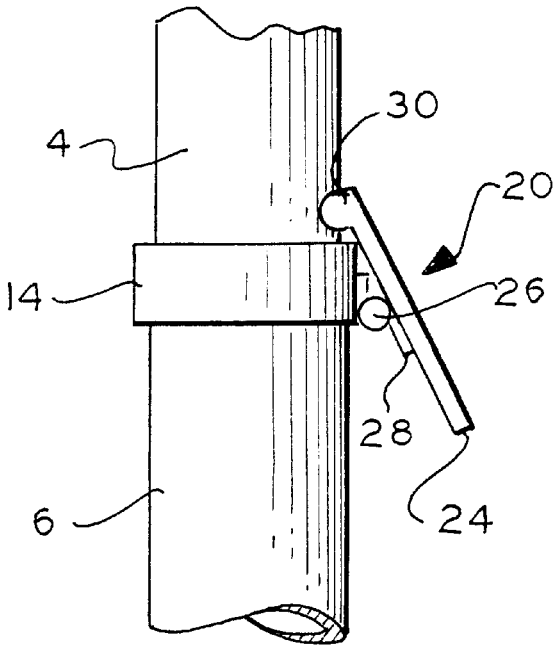
FIG. 19
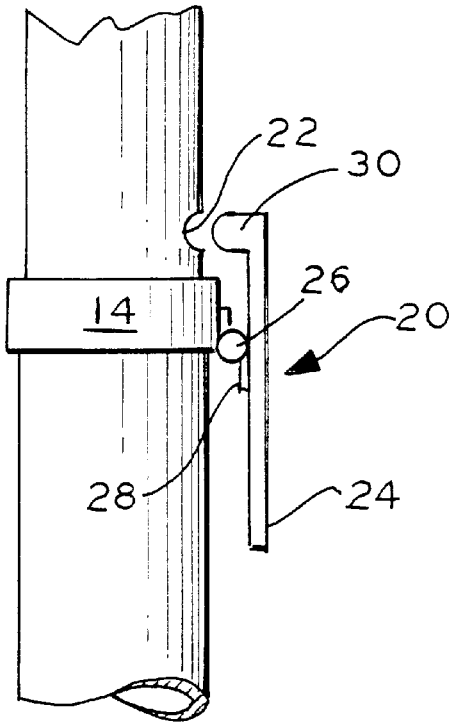
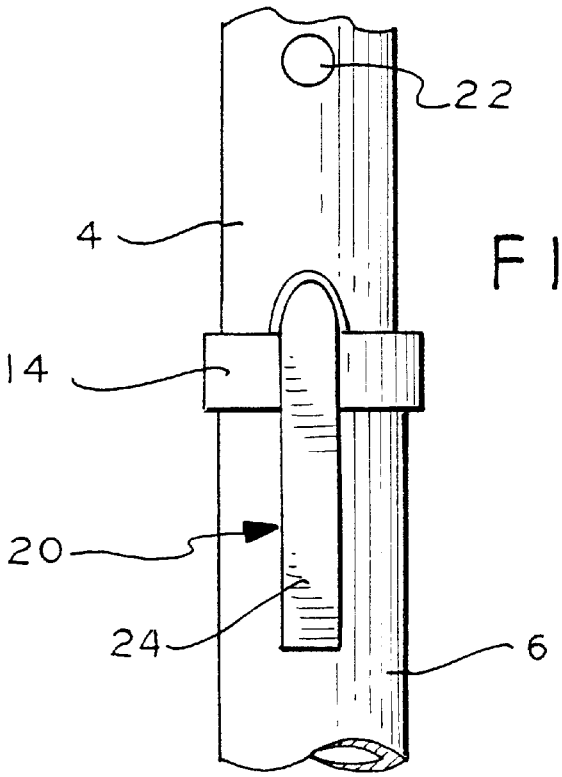
FIG. 20

CANE AND GRASPING DEVICE

BACKGROUND OF THE INVENTION

1. Field of the Invention

The present invention relates to canes having a handle at one end and an article grasping devices at the other end.

2. Description of Related Art

The elderly and handicapped may use canes in order to help them walk. Some canes terminate with a quadriped base, which is basically a square plate having four separate feet at the four corners to provide additional stability. Cane users often have difficulty bending over to retrieve objects on the floor. For this reason, canes have been developed with grasping devices.

For example, U.S. Pat. Nos. 5,176,160, 5,636,650 and 5,640,985 each disclose a combination cane and article grasping apparatus. A hook shaped article grasping jaw element is pivotally secured to the cane next to the cane foot. The element in the closed article grasping state grips the article by squeezing the article against the cane. The element is operated by a lever near the handle and a link mechanism. This is unsatisfactory because the jaw element is hooked shaped and exposed at all times and could accidentally cause injury to the user in certain circumstances. For example, the hooked element can catch on the user's clothing and causing the user to trip and fall. Furthermore, the tip of the cane is subject to wear during ordinary use. Such wear will affect the accuracy of the mating with the jaw element. Moreover, this design is not suitable for quadriped bases.

U.S. Pat. No. 3,763,872 discloses a pickup device for a cane or crutch. The lower end of the cane is a hollow tubular member that slidably receives a complementary telescoping post. The post lower end serves as the tip of the cane. A gripper is formed in one side of the post comprising one or more bent fingers received in the tubular end of the cane when the post is recessed, the fingers extending longitudinally alongside the post and are biased to permit them to protrude radially outwardly. The fingers are spring material that normally are biased open and closed when the post is slid in the tubular member over the fingers. A retaining screw secures the post to the tubular member via a slot. This apparatus suffers the disadvantage in that the user must press the telescoping members against a surface in order to telescope the post and tubular member in order to close the fingers. The fingers also grip the article to be grasped against the post. If a convenient surface is not available adjacent to the article to be gripped, so as to permit pressing the cane post and member against, then the gripping member can not be operated. For example, an article floating in water, on an overhead shelf or on a soft surface can not be easily retrieved or gripped by this device. Also, the cane foot tends to get dirty in use and pressing it against a surface might pass dirt onto that surface undesirably.

U.S. Pat. No. 4,966,316 discloses a shoe horn and associated mechanism at the end of a cane. U.S. Pat. No. 5,810,466 discloses a flashlight in the handle of a walking cane.

None of the above patents recognize the need for a cane and article grasping device that can independently grip an article regardless the location and surface on which the article is located and also does not have protruding elements which can cause injury. Also, the prior art does not have the means for preventing damage and wear at the gripping point; or provide enough adaptability to permit use with the quadriped base. Furthermore, the prior art does not consider concealing the grasping device when no longer needed in order to maintain the appearance of an ordinary cane and avoid the suggestion of a serious disability requiring the use of such a grasping device.

SUMMARY OF THE INVENTION

In accordance with the illustrative embodiments demonstrating features and advantages of the present invention, there is provided a cane and grasping device including an elongated member having distal and proximal ends along a longitudinal axis. This elongated member has a handle secured to the proximal end of the elongated member, and a sheath. Also included is an article grasping device having open and closed states. This article grasping device is deployable between (a) a protected position sheathed within the sheath, and (b) an operative position exposed externally of the elongated body at the distal end. Also included is a device operator coupled to the elongated body for operating the grasping device in the operative position for grasping an article.

In one aspect, the arrangement includes a telescoping pair of tubular sleeves. One of the sleeves supporting the article grasping device.

In a further aspect, the device in the sleeve is in the protected position, the sleeve being selectively movable to place the device in the operative condition.

In a still further aspect, the sleeve and tube include cooperating latch means for adjusting the position of the sleeve relative to the first tube along the longitudinal axis to adjust the length of the cane.

Preferably, the article grasping device comprises a pair of opposing jaws having a closed state and an open state, and bias means for biasing the jaws open in the operative position.

In one aspect, the device operating means comprises link means associated with the handle for selectively placing the open jaws in the closed state to grasp an article.

In a further aspect, a bias means includes means arranged to automatically open the jaws when the jaws are placed in the operative position.

Preferably, the article grasping device comprises first and second opposing jaws having an article grasping closed state and an open state, and bias means for normally biasing the jaws open in the operative position, the jaws being pivotally secured to the first tube opposite the proximal end.

In a further aspect, the device operating means comprises a lever pivotally secured to a first tube at first end and adjacent to the handle, the lever having a quiescent position and a jaw closing position for placing the jaws in the closed state, and link means coupled to the lever and to the jaws for selectively closing the jaws to grasp an article in the device operative position.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 4 is a front elevation view, partly in section, of a portion of the device of FIG. 1 showing the article gripping mechanism;

FIG. 5 is a side elevation sectional view of an assembled portion of the device of FIG. 1 similar to the portion of FIG. 4;

FIG. 12 is an isometric view of the jaws of the grasping device in the closed state;

FIG. 13 is side elevation view of the embodiment of FIG. 12;

FIGS. 14 and 15 are respective front elevation and exploded isometric partial views of the jaw operating mechanism of a further embodiment of the present invention;

FIGS. 18–20 are elevation views showing the latching detent for attaching the sheath to the upper tubular member.

DETAILED DESCRIPTION OF THE PREFERRED EMBODIMENTS

Figure 1:
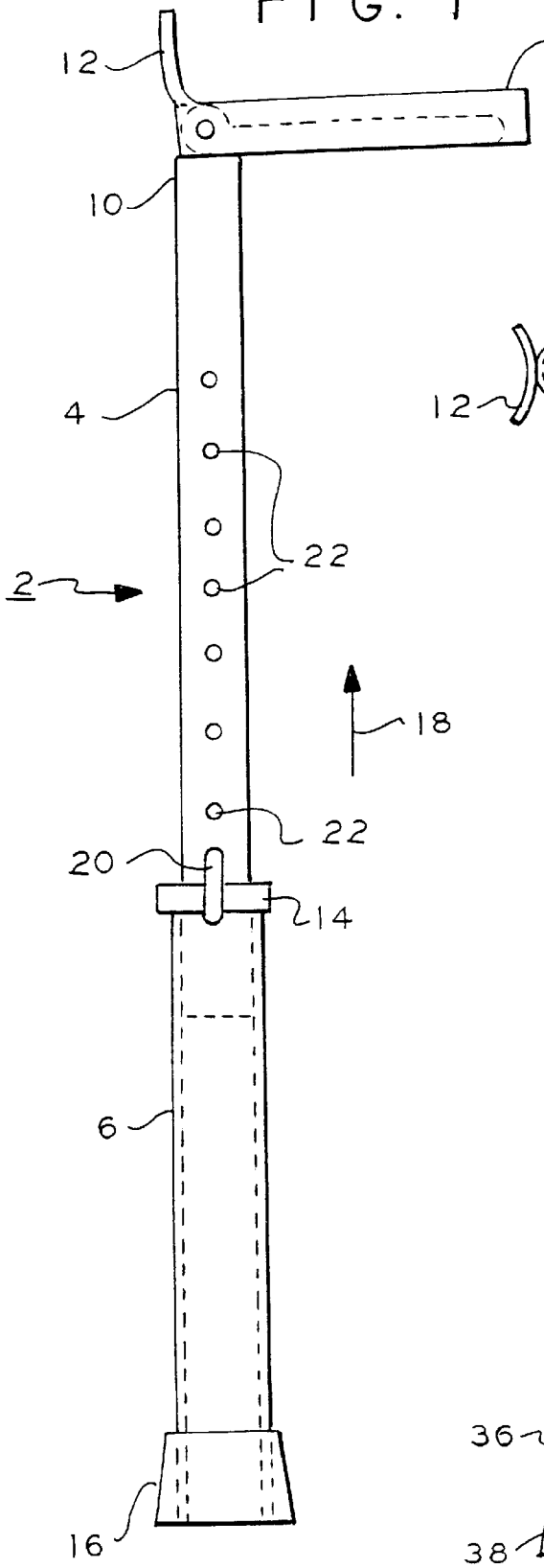
FIG. 1 is a side elevation view of a cane and article grasping device according to the present invention.
Figure 2:
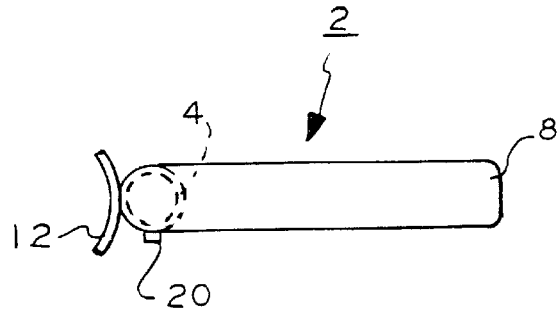
FIG. 2 is a top plan view of the device of FIG. 1.

Referring to FIGS. 1 and 2, cane and grasping device assembly 2 comprises an upper tubular member 4 and a telescopic lower sleeve 6. The assembly is referred to herein as an elongated member. A handle 8 is attached to the proximal end 10 of the member 4. A shoe horn 12 is attached to the upper edge of end 10 of the member 4.

The sheath 6 is a hollow tube, preferably metal, having a collar 14 at one end and a rubber or other elastomeric or plastic foot 16 at the lowermost end. In other embodiments sheath 6 may be a split (C-shaped) tube with a non-circular perimeter (for example, polygonal, elliptical, or other shapes). In other embodiments sheath 6 may be formed of a number of spaced fingers that can encircle and grip member 4. In still other embodiments, sheath 6 may be a helical member that can be slid or threaded onto member 4.

In some embodiments the foot may be hollow to permit the sleeve 6 to slide up the outer surface of the member 4 in direction 18 such that member 4 may protrude through the foot 16. In other embodiments, foot 16 will be closed and the sheath 6 can be removed by pulling it in a direction away from end 10. The sheath 6 collar 14 has a latching pawl 20 pivotally attached thereto.

The upper tubular member 4, which also preferably is metal or other tubular materials as normally used for canes, has a linear array of apertures 22. The apertures receive the pawl device 20 for axially securing the lower sheath in any desired selected axial position along the longitudinal length of the cane to set the length of the cane. In preferably, an identical set of apertures will be placed on the op. cit. side of member 4. This enables a user to position the pawl device 20 on either of the right or left side of member 4 to facilitate either right or left hand use.

In FIGS. 18–20, the pawl device 20 comprises a lever 24 pivotally attached to collar 14 by pivot pin 26 secured to the collar 14. A torsion spring 28 normally biases the lever in the position of FIG. 18. A pawl 30 is at an end of lever 24 for engagement with a selected aperture 22. The spring 28 biases the pawl in that engagement. This engagement axially locks the sheath in place to the upper tubular member 4. Depressing the lever to disengage the pawl from aperture 20 permits the sheath to be manually displaced over the member 4 toward the handle 8, FIG. 1 or in the alternative, to totally remove the sheath 6 from engagement with the upper tubular member 4. In some embodiments pawl device 20 may be replaced with a threaded locking collar that can thread onto the upper end of sheath 6 and squeezed that upper end. This upper end may be slitted to permit such squeezing. Other types of locking and clamping mechanisms are possible to set the relationship between member 4 and sheath 6.

In one alternative, the sheath 6 may be replaced with sheath 32 (FIG. 3) which is attached to plate 34. Four legs 36, two being shown, depend from the plate 34. The sheath, legs and plate may be a single, integrally molded, plastic unit, although other embodiments may employ a separate metal plate to which the sheath and legs are attached. Rubber or elastomeric feet 38 may be attached to the bottom of each leg 36. This forms a quad support (quadriped) for the cane in the place of a single foot as in FIG. 1. Plate 34 is preferably continuous, but in some embodiments may have a hole to allow the grasping member to extend through the plate as the base is slip upwardly on the cane.

In FIGS. 4 and 5, article grasping assembly 40 is attached in the hollow interior of the upper tubular member 4. The assembly 40, comprises two complementary jaws 42 and 44 pivotally secured about shaft pin 46. Pin 46 is secured to member 4. The jaws 42 and 44 have complementary meshing teeth 48 and 50, respectively. The teeth are aligned in a linear array in two adjacent arrays on each jaw. The jaws are stamped metal and may be steel or aluminum.

Figure 17:
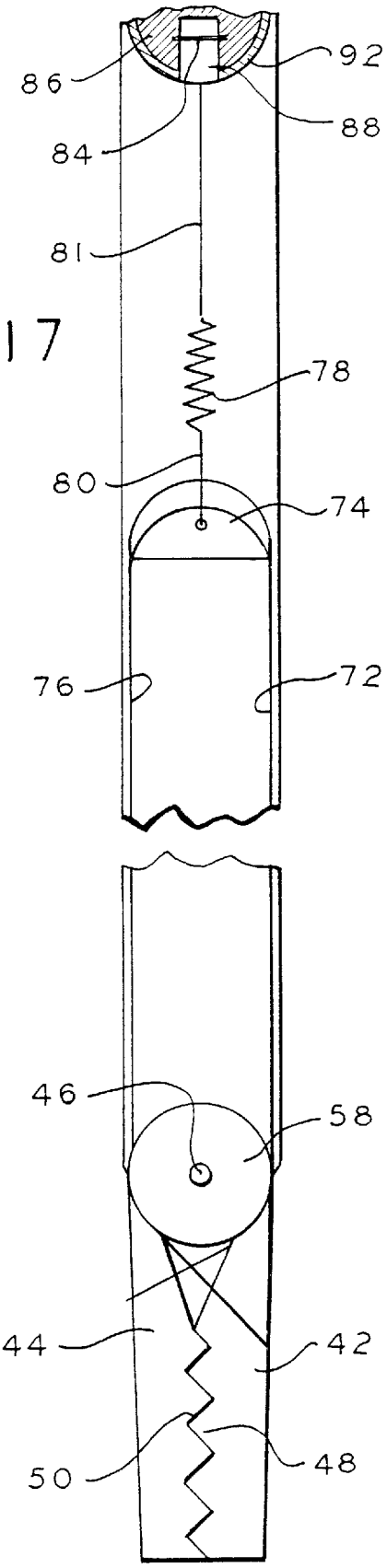
FIG. 17 is a more detailed front elevation of the jaw operating mechanism with the grasping jaws closed.

In FIGS. 12 and 17, the jaws 42 and 44 are shown in the closed meshed state and in FIG. 4, they are shown in the open state. The jaws also have interdigitating fingers 52 and 54 (sometimes referred to as rat's teeth) when the jaws are closed for grasping different shaped articles than that grasped by jaws 42 and 44 and for lifting articles within the closed jaws hollow interior 56.

Figure 16:
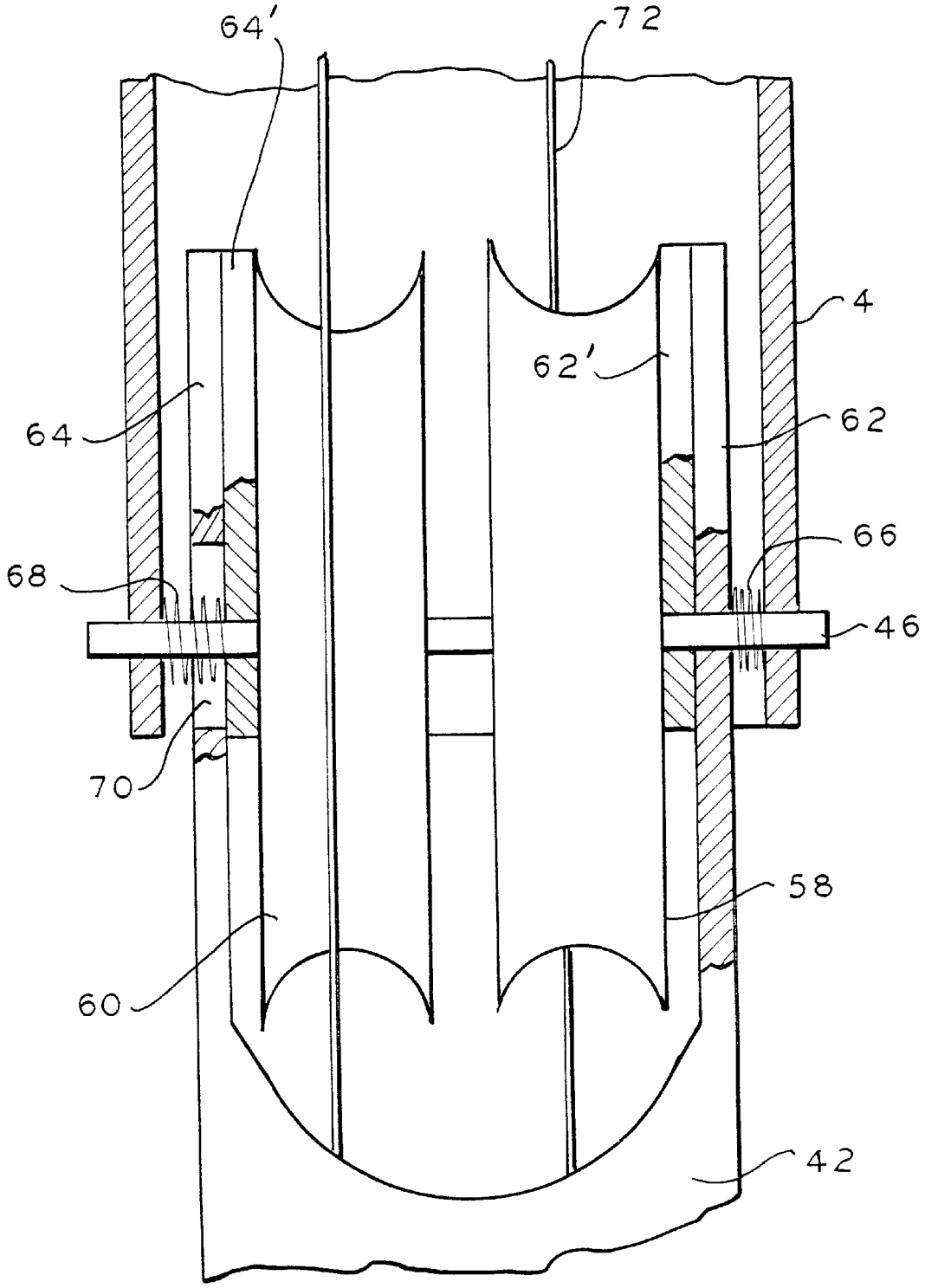
FIG. 16 is a more detailed, elevational view of the pulley portion of the embodiment of FIG. 1.

In FIG. 16, two pulleys 58 and 60 are rotatably mounted to pin 46 and are axially positioned at a fixed location on pin 46 by known elements (not shown), such as bearings and the like, which are press fit onto the pin 46. The jaw 42 has two flanges 62 and 64 for rotatably mounting the jaw to the pin 46. The other jaw 44 has two flanges 62' and 64' rotatably mounting jaw 44 to pin 46. A torsion spring 66 is secured to flange 62 and to member 4 for biasing the jaw 42 to the normally open position of FIG. 4. A torsion spring 68 is secured to flange 64' through opening 70 in flange 64. The spring 68 is also connected to the member 4 to bias the jaw 44 open. These springs 66 and 68 bias the jaws to the position of FIG. 4.

In FIGS. 4 and 5, a cable assembly operates as a link including a cable 72 which may be metal or other material such as known high strength fibers, or plastics, such as nylon, and so on, engages the pulley 58 and is tied to the jaw 44. The cable run is attached to one side of bracket 74. Attached to the other side of bracket 74 is cable 76. Cable 76 has a run that engages pulley 60 and is attached to jaw 42.

In FIGS. 4 and 5, the bracket 74 is attached to spring 78 by a wire or cable 80. Spring 78 is attached by a wire 81 to cylindrical plug 82 having an annular ridge 84. In side handle 92, a bob 86 has a cylindrical bore 88 for receiving plug 82. The bore 88 has an annular groove 90 for loosely, snap-fit receiving the ridge 84 so that the plug 82 freely rotates in bore 88 and is axially locked in the bore 88.

A lever 92 is pivotally mounted to member 4 by pin 94 and may have a U-shaped cross-section. The handle 8 has an inverted U-shaped cross-section and is attached externally to the member 4. The lever 92 is attached to the member 4 internally. The lever 92 can retract into the channel 96 of the handle 8. The lever 92 passes through a slot 97 in the member 4.

When the jaws are open as in FIG. 4, the lever is in the position of FIG. 5. One arm 95 of a spiral torsion spring is shown bearing against the inside of member 4 to provide a force tending to retract lever 92 from the position shown in FIG. 5 to that shown in FIG. 1. Normally, spring 95 cannot overcome the countervailing forces from previously mentioned torsion springs 66 and 68 (FIG. 16). Spring 95 can, however, cause lever 92 to retract when jaws 42 and 44 are forcibly closed, as described herein.

In operation, the jaws 42 and 44 are closed as shown in FIG. 17 (manually or by operating lever 92) and the lower sheath 6 is telescoped over the upper tubular member 4, FIG. 1. The detent assembly is located so that pawl 30, FIGS. 18–20, engages an aperture 22 setting the appropriate length of the cane for the individual using it. The sheath 6 is sufficient long to allow for a wide range of adjustment lengths, the drawings not being to scale. The sheath may have a single foot 16 as in FIG. 1 or a quad foot assembly as in FIG. 3. With the sheath 6 in place the jaws 42 and 44 are safely encased within the sheath 6.

Figure 3:
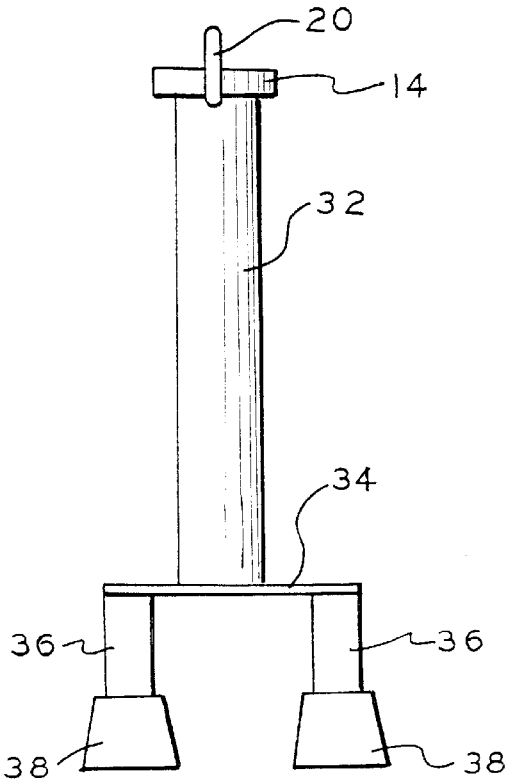
FIG. 3 is a front elevation view of a lower portion sheath and foot assembly, which is an alternative embodiment for use in the embodiment of FIG. 1 in place of the foot and sheath shown in FIG. 1.
Figures 6, 7, 8, 9, 10, 11:
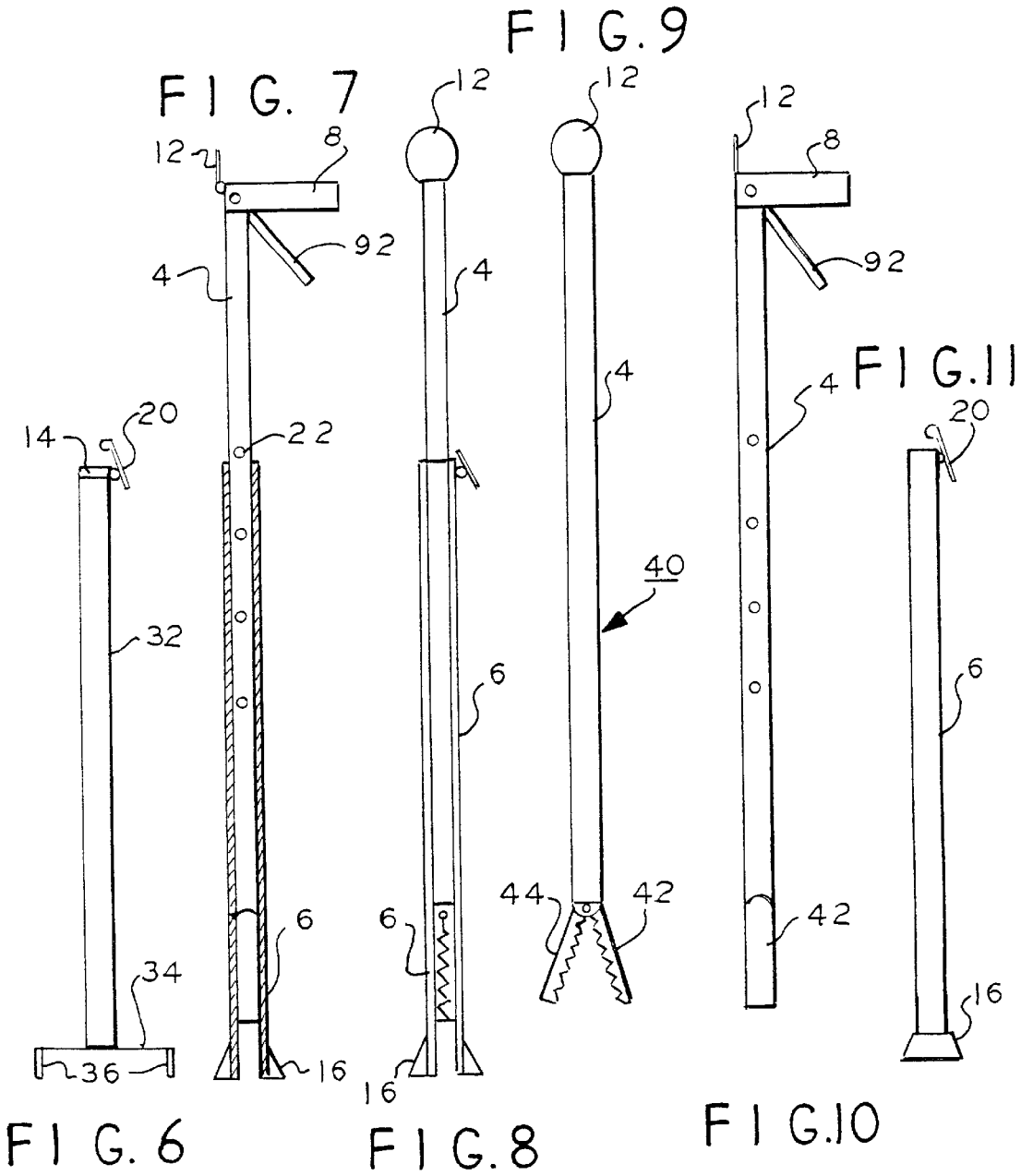
FIG. 6 is a front elevation view of the embodiment of FIG. 3.
FIG. 7 is a side elevational view, partially in section, of the embodiment of FIG. 1.
FIG. 8 is a front elevational view, partially in section, of the embodiment of FIG. 7.
FIG. 9 is a side elevation view of the upper portion of the device of FIG. 1.
FIG. 10 is a side elevation view of the embodiment of FIG. 9.
FIG. 11 is a front elevation view of the lower portion sheath and foot of the embodiment of FIG. 1.

To use the grasping device 40, FIG. 9, the sheath 6 may be displaced toward the handle 8, FIG. 7 until the jaws 42 and 44, FIG. 3, are exposed. In the alternative, the sheath 6 may be removed entirely from the grasping device 40 and member 4 as shown in FIGS. 4 and 9. The user may secure the sheath to his or her clothing using clip 20. Alternatively, for the embodiment employing the quadriped base of FIG. 3, the user may simply place the unit in on its feet and it will remain erect and easily retrieved without bending over.

With the sheath removed, the torsion springs 68 and 70 (FIG. 16) automatically bias the jaws open to the state shown in FIGS. 4 and 9. The user then grasps the handle 8 and the lever 92, squeezing them together causing the jaws to close as in FIG. 17, and grasp an article (not shown). The jaws 42 and 44 will grasp an article regardless of the environment of the article. Thus articles floating in water can be retrieved with ease as will as articles on shelves, delicate surfaces and so on.

In FIGS. 14 and 15, in the alternative cable assembly, a bracket 98 comprises a C-shaped tube 100 and a web or flange 102. Cables 72' and 76' are in fact a single cable threaded through the tube 100 to make the two runs. The bracket flange 102 is connected to spring 104 by a clip 106. The spring 104 is connected to plug 108 which is the same as plug 82 FIG. 4 and connected to the lever 92 as shown in FIGS. 4 and 5.

While the jaws 42 and 44 normally close in alignment with the length of the cane, other types of alignments will be permitted with the embodiment of FIG. 14. After an object is gripped by jaws 42 and 44, a user may wish to change the angle between the cane and the jaws. This embodiment will support this type of motion. In particular, jaws 42 and 44 may be angularly displaced, in which case, cables 72'/76' will shift through the tube 100. This type of movement also provides a degree of strain relieved that prevents excessive force on the mechanism.

Strain relief is also provided by spring 104 in the embodiment of FIG. 14 (or by spring 78 for the embodiment of FIG. 4). In particular, an overzealous user may squeeze handle 92 (FIG. 5) excessively. This excessive force, however, will only cause spring 104 to stretch and thereby moderate the forces on cables 72'/76' and jaws 42 and 44 and avoid damage to the mechanism.

Other types of link mechanisms are possible. For example, some embodiments may employ a single cable or rod that connects to a scissor-like mechanism, for example, a caliper-like mechanism as used in bicycle brakes. In still other embodiments, one of the jaws can be stationary and therefore only one item need be rotated by the link mechanism. Furthermore, the link need not be mechanical and may employ a hydraulic line to actuate a piston, an electrical circuit operating a solenoid, etc. Additionally, some links may be located externally or in a recess on the side of the in cane assembly, in which case the upper elongated member need not be hollow.

It will occur to one of ordinary skill that various modifications may be made to the disclosed embodiments. It is intended that the invention be defined by the appended claims. For example, the jaws may have any desired configuration with or without teeth. The shape and configuration of the teeth is not critical. The brackets, cables and associated hardware may take any shape and configuration according to a given implementation.

Obviously, many other modifications and variations of the present invention are possible in light of the above teachings. It is therefore to be understood that within the scope of the appended claims, the invention may be practiced otherwise than as specifically described.

What is claimed is:

1. A cane and grasping device comprising:

an elongated member having a tube with distal and proximal ends along a longitudinal axis, and having a sheath attached to said distal end releasably in order to allow displacement of said sheath;

a handle secured to the elongated member at the proximal end;

an article grasping device having open and closed states, and being deployable between (a) a protected position sheathed within the sheath, and (b) an operative position exposed externally of the elongated member at the distal end, the gripping device being secured to said tube at the distal end; and a device operator coupled to the elongated member for operating the grasping device In the operative position for grasping an article.

2. The cane of claim 1 wherein the elongated member is releasably received in the sheath.

3. The cane of claim 2 wherein the sheath is selectively movable to place the gripping device in the operative condition.

4. The cane of claim 1 wherein the sheath and tube include a cooperating latch for adjusting the position of the sheath relative to the tube along the longitudinal axis to adjust the length of the cane.

5. The cane of claim 1 including a shoe horn extending from the proximal end of the elongated member.

6. The cane of claim 1 wherein the article grasping device comprises:

a pair of opposing jaws having a closed state and an open state, and a bias device for biasing the jaws open in the operative position.

7. The cane of claim 6 wherein the device operator comprises:

a link associated with the handle for selectively placing the jaws in the closed state to grasp an article.

8. The cane of claim 6 wherein the bias device includes means arranged to automatically open the jaws when the jaws are placed in the operative position.

9. The cane of claim 2 wherein the article grasping device comprises:

first and second opposing jaws having an article grasping closed state and an open state, and a bias device for normally biasing the jaws open in the operative position, the jaws being pivotally secured to the tube opposite the proximal end.

10. The device of claim 9 wherein the device operator comprises:

a lever pivotally secured to the tube at the proximal end and adjacent to the handle, the lever having a quiescent position and a jaw closing position for placing the jaws in the closed state, and a link coupled to the lever and to the jaws for selectively closing the jaws to grasp an article in the device operative position.

11. The device of claim 10 wherein the link comprises:

a cable assembly coupled to the lever and having a first run connected to the first jaw and a second run connected to the second jaw.

12. The device of claim 11 wherein the link includes:

first and second pulleys pivotally secured to the tube opposite the proximal end, for operatively engaging the first and second runs, respectively.

13. The device of claim 2 including a pawl secured to one of the sheath and tube, the other of the tube and sheath having a plurality of spaced pawl receiving apertures each for selectively receiving the pawl for selectively securing the sheath at different positions along the length of the tube to adjustably set the length of the cane.

14. The device of claim 13 wherein the pawl has a first biased aperture engaging position, and a release position.

15. The device of claim 1 wherein the grasping device comprises:

a pair of biased normally open jaws, the jaws each having a set of article grasping teeth, the teeth of the jaws meshing in the closed state.

16. The device of claim 2 wherein the sheath includes at least one foot for supporting the cane during use.

17. The device of claim 16 wherein the at least one foot comprises a plurality of feet.

18. A cane and grasping device:

an elongated member having distal and proximal ends along a longitudinal axis, and having a sheath;

a handle secured to the elongated member at the proximal end;

an article grasping device having open and closed states, and being deployable between (a) a protected position sheathed within the sheath, and (b) an operative position exposed externally of the elongated member at the distal end, said article grasping device including a pair of biased normally open jaws, the jaws each having a set of article grasping teeth, the teeth of the jaws meshing in the closed state; and a device operator coupled to the elongated member for operating the grasping device in the operative position for grasping an article, said article grasping device comprising:

a shaft secured to the elongated member adjacent to the distal end, and a spring secured to the elongated member and to each of said jaws for biasing the jaws open.

19. The device of claim 15 wherein the jaws further include interdigitated fingers different than the teeth for grasping an article.

20. The device of claim 15 wherein the teeth are arranged in a pair of linear arrays on each jaw, an array of teeth on one jaw meshing with an array of teeth on the other jaw.

21. The device of claim 11 wherein the first tube and sheath define a longitudinal axis, the grasping device including pivot means for coupling the cables to the lever for permitting the cables and jaws to be placed in any angular orientation about the longitudinal axis.

22. A cane and grasping device comprising:

at least one hollow elongated tubular member having opposite first and second ends;

a sheath having third and fourth ends releasably secured to the tubular member at the member second end;

a handle secured to the tubular member at the first end;

an article grasping device having a normally biased open article receiving state and a protected closed article grasping state, the grasping device being secured to the tubular member second end externally the member and normally in an open operative state, the sheath having a cane operating position enclosing the grasping device in a device protected closed state and a device operating position wherein the grasping device is exposed and assumes the open state, displacement of the sheath from the cane operating position to the device operating position exposing the grasping device; and device operator coupled to the tubular member at the first end adjacent to the handle and to the grasping device to selectively place the exposed device in the closed state for grasping an article.

23. The device of claim 22 including detent means for selectively securing the sheath to the tubular member at different axial positions on the tubular member.

24. The device of claim 22 wherein the device operator includes two cables and a lever, the lever pivotally secured to the tubular member adjacent to the handle, the cables being connected to the lever at one cable end, the grasping device comprising a pair of jaws pivotally secured to the tubular member at the second end, each cable being connected to a different jaw for closing the corresponding jaw in response to operation of the lever.

* * * * *